US005385039A

United States Patent [19]

Feldpausch et al.

[11] Patent Number: 5,385,039

[45] Date of Patent: Jan. 31, 1995

[54] ELECTRONIC LOCK

[75] Inventors: Thomas G. Feldpausch, Hastings; Joseph R. Branc, Grand Rapids; Robert B. Lubinskas, Hastings, all of Mich.

[73] Assignee: Steelcase Inc., Grand Rapids, Mich.

[21] Appl. No.: 6,742

[22] Filed: Jan. 21, 1993

[51] Int. Cl.[6] ..... E05B 65/46

[52] U.S. Cl. ..... 70/78; 312/219; 70/DIG. 27; 70/277; 70/278; 70/85

[58] Field of Search ..... 70/78, 82, 85, 275, 70/277, 278, DIG. 20, DIG. 27; 312/217, 216, 219

[56] References Cited

U.S. PATENT DOCUMENTS

| | | | |
|---|---|---|---|
| 1,951,418 | 3/1934 | Jacobi | 70/DIG. 27 |
| 2,046,831 | 7/1936 | Lowe | 70/DIG. 20 |
| 3,497,280 | 2/1970 | Olree et al. . | |
| 3,787,812 | 1/1974 | Armstrong | 70/278 |
| 3,831,408 | 8/1974 | Featherman . | |
| 3,944,976 | 3/1976 | France . | |
| 3,976,343 | 8/1976 | Breckner et al. | 292/DIG. 14 |
| 4,196,347 | 4/1980 | Hadley . | |
| 4,196,418 | 4/1980 | Kip et al. . | |
| 4,250,533 | 2/1981 | Nelson . | |
| 4,388,524 | 6/1983 | Walton . | |
| 4,392,133 | 7/1983 | Lundgren . | |
| 4,409,806 | 10/1983 | Propst . | |
| 4,766,746 | 8/1988 | Henderson et al. . | |
| 4,848,115 | 7/1989 | Clarkson et al. . | |
| 4,887,292 | 12/1989 | Barrett et al. . | |
| 4,914,732 | 4/1990 | Henderson et al. . | |
| 4,916,443 | 4/1990 | Barrett et al. . | |
| 4,966,422 | 10/1990 | Albright et al. | 312/217 |
| 4,972,182 | 11/1990 | Novik et al. . | |
| 4,988,987 | 1/1991 | Barrett et al. . | |
| 5,061,923 | 10/1991 | Miller et al. . | |
| 5,083,122 | 1/1992 | Clark . | |
| 5,158,347 | 10/1992 | Warren et al. . | |

FOREIGN PATENT DOCUMENTS

| | | | |
|---|---|---|---|
| 0229373 | 9/1990 | Japan | 70/278 |

*Primary Examiner*—Peter M. Cuomo
*Assistant Examiner*—Darnell M. Boucher
*Attorney, Agent, or Firm*—Price, Heneveld, Cooper, DeWitt & Litton

[57] ABSTRACT

A lock for furniture includes a plunger assembly for actuating a lock mechanism. The plunger assembly includes a reader for receiving a control signal from a key. The plunger assembly includes a curved surface for contacting a lock rod such that the plunger assembly requires a constant force to move the lock rod through its range of motion to a locked position. A catch assembly secures the plunger, and hence the lock rod, in a locked position. A solenoid shifts the catch assembly to release the plunger assembly. The lock assembly may also include a lever connected at one end to the catch assembly and having a counterweight on an opposite end.

28 Claims, 6 Drawing Sheets

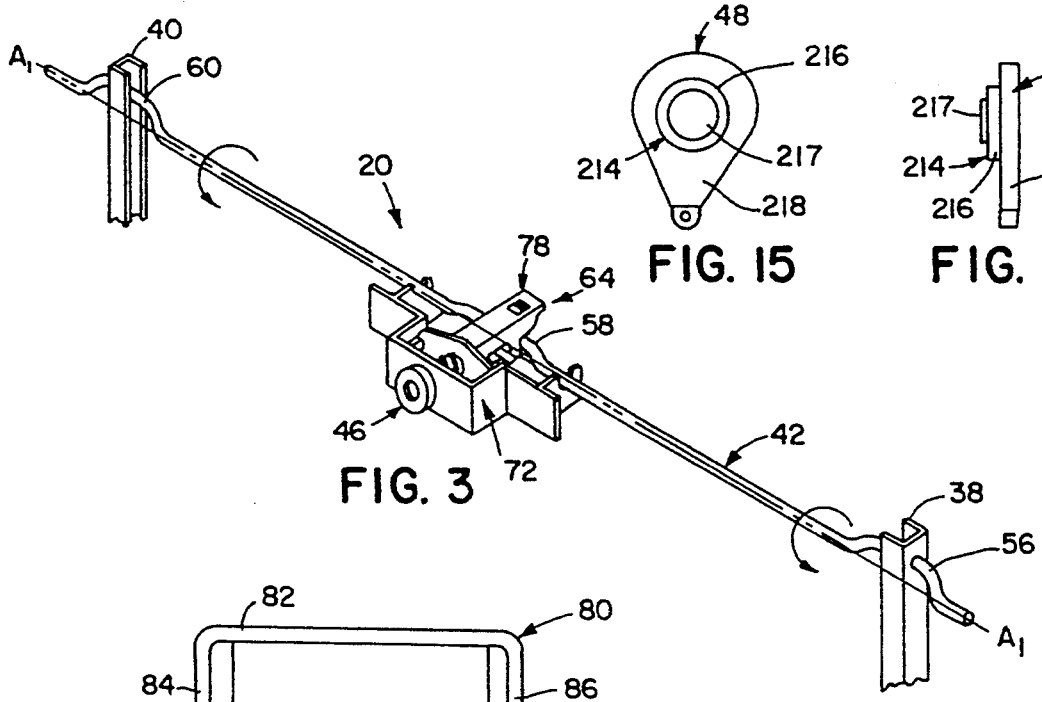
FIG. 3
FIG. 15
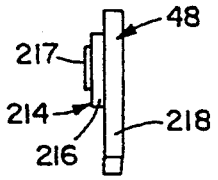
FIG. 16
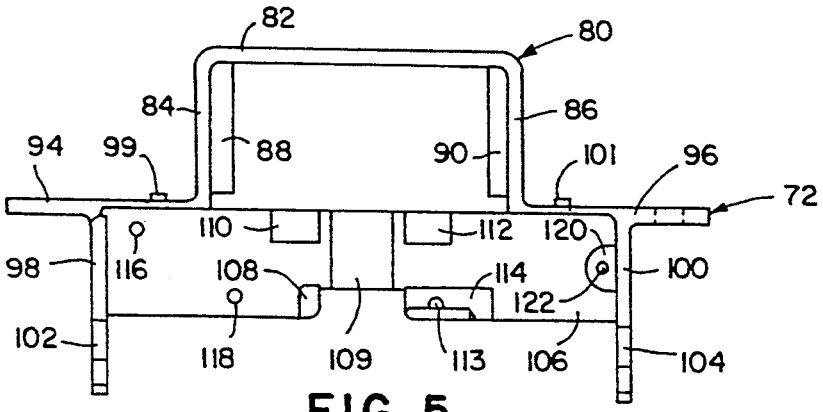
FIG. 5
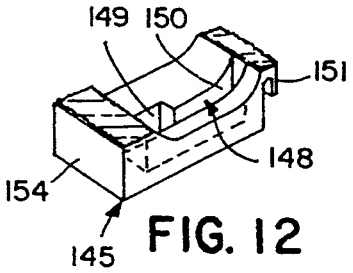
FIG. 12
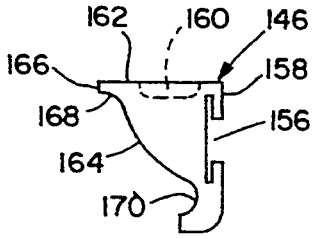
FIG. 13
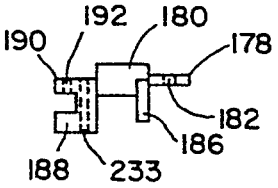
FIG. 14

ELECTRONIC LOCK

BACKGROUND OF THE INVENTION

The present invention pertains to electronic locks and, more particularly, to an electronic lock for furniture.

A wide variety of locks are utilized in the furniture industry. Size, ease of installation, and appearance are important considerations in selection of a lock for a particular furniture design. Security and cost are also important considerations in selection of a lock for a furniture unit. Manually actuated twist and plunger locks are two examples of lock mechanisms which are widely utilized in furniture.

A number of difficulties are presented by known manually actuated locks. At the factory where these locks are installed in a furniture unit, the unique key that actuates the lock must be matched to the furniture unit in which the lock is installed. Additionally, the key generally remains with the furniture unit until the end consumer actually takes possession. After the customer takes possession, they occasionally lose keys. In the case of office furniture, employees often take keys with them after they leave employment with a company. Security considerations may require replacement of the lock if keys are lost or taken.

Because each lock uses a unique key, which must be replicated if lost, it is difficult to quickly replace lost or stolen keys. Some companies maintain records of keys for each furniture unit that they manufacture. New keys may be then obtained from the manufacturer. However, it is time consuming and costly for the manufacturer to generate and maintain such records. Additionally, it takes time to ship new keys to the customer.

An alternative to replacing a lost key is replacement of the lock. However, it is costly and time consuming to replace the lock. The services of a locksmith are generally required.

An alternative to manual key actuated locks are combination locks. Combination locks require that the user enter an access code, either electronically or mechanically, to unlock the furniture. Although these locks do not require a unique key, users are required to maintain the access code. However, users often forget their access code. Security problems are presented if the user maintains a written record of the code.

Electronic combination locks are known which use stored codes to control a lock. Application of such locks to furniture units may require significant alteration of the furniture unit to accommodate the electronic lock mechanism. Such locks have not been effectively adapted to the furniture environment, and do not practically allow retrofitting in existing furniture units. Additionally, electronic combination locks generally suffer from the same disadvantages of manual combination locks. Such locks may be costly, complex and may present similar security problems.

SUMMARY OF THE INVENTION

The electronic lock according to the invention provides a lock for furniture units which is easy to install, cost effective and secure. The lock may be retrofit into a variety of different furniture applications, and provides electronic key actuation in a furniture unit.

A lock according to the invention includes a plunger assembly for engaging a locking element in a furniture unit. A catch assembly is operably coupled to the plunger assembly. The lock also includes a receiver. Provision is made for controlling the catch assembly to release the plunger responsive to a control signal input to the receiver.

According to narrower aspects of the invention, the receiver is mounted in the plunger assembly. The plunger assembly may also include a recess and a spacer positioned in the recess. In the preferred embodiment of the invention, the plunger has a curved surface for contacting a locking element in the furniture unit such that the force required to move the plunger assembly and locking element is constant throughout movement of the plunger assembly.

The electronic lock according to the invention is small in size, making it useful in a variety of different applications. It is unobtrusive, such that it does not detrimentally effect the appearance of the furniture unit in which it is installed. It is easy to use and provides security for the contents of the furniture unit. The electronic lock may be retrofit into existing furniture units.

These and other objects, aspects and features of the invention will be more fully understood and appreciated by reference to the written specification and the appended drawings.

BRIEF DESCRIPTION OF THE DRAWINGS

FIG. 3 is an enlarged perspective view of an electronic lock according to FIG. 2 and a fragmentary view of the lock bars;

FIG. 5 is an enlarged top elevational view of a lock box for the lock according to FIG. 4;

FIG. 12 is a cross-sectional view of the wedge block according to FIG. 10 taken along plane XII—XII;

FIG. 13 is a side elevational view of a rod engagement member in the lock assembly according to FIG. 4:

FIG. 14 is a side elevational view of a catch of the lock assembly according to FIG. 4;

FIG. 15 is a front elevational view of a key used with the electronic lock according to FIG. 1;

FIG. 16 is a side elevational view of the key according to FIG. 15;

DESCRIPTION OF THE PREFERRED EMBODIMENT

Figure 1:
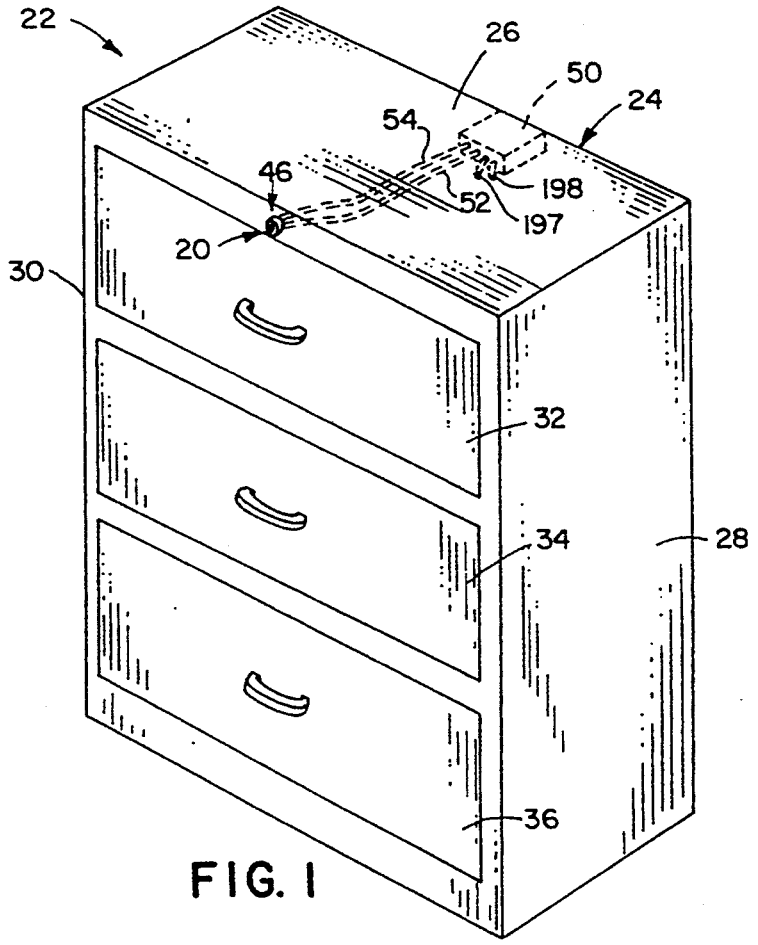
FIG. 1 is a front perspective view of a furniture unit in which a lock according to the invention may be advantageously utilized.
Figure 2:
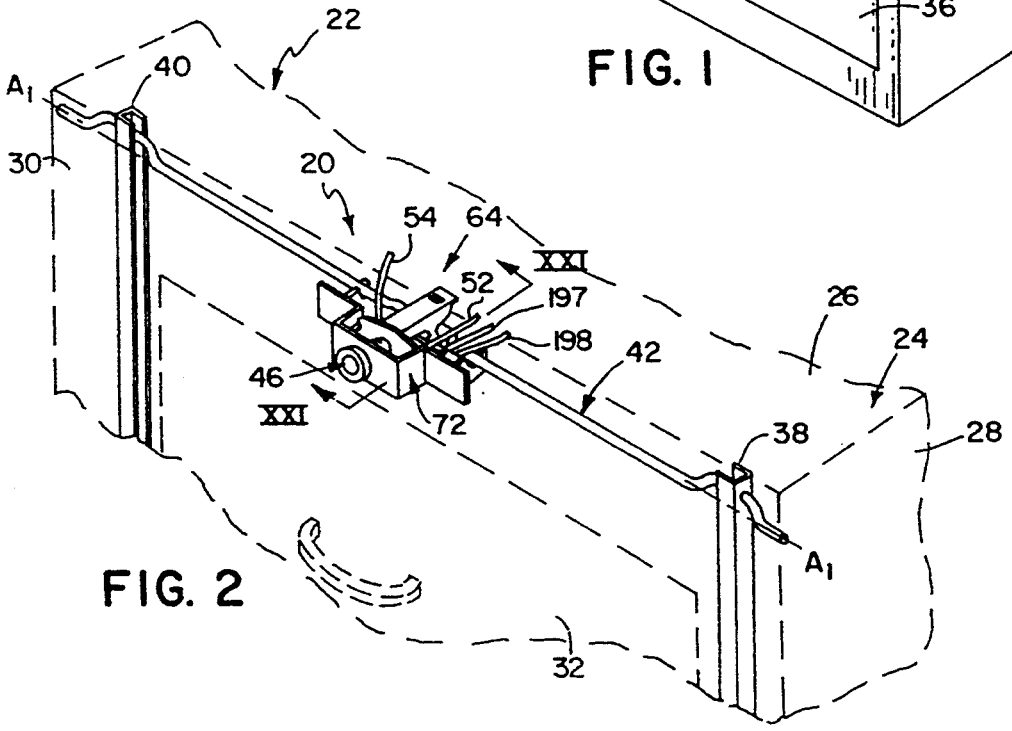
FIG. 2 is a perspective view of an electronic lock according to the invention and a fragmentary view of the furniture unit according to FIG. 1 shown in phantom.

An electronic lock 20 according to the invention is illustrated in a vertical file cabinet 22 in FIGS. 1 and 2. However, it will be recognized by those skilled in the art that features and advantages of the electronic lock will find application in other furniture. For example, the electronic lock may be used in desks, binder bins, lateral files, or the like. Accordingly, "furniture" as used herein includes all such devices and their equivalents. Additionally, although the invention is illustrated as a plunger lock, the lock mechanism may be advantageously utilized with a twist lock, as briefly described hereinbelow. Accordingly, "lock" as used herein includes all such devices and their equivalents.

The illustrated vertical file cabinet 22 includes a casing 24 having a top wall 26, a side wall 28, a front wall 30, and opposite bottom, side and back walls which are not shown. Vertically aligned drawers 32, 34, and 36 are positioned in casing 24 in a conventional manner. Lock bars 38 and 40 are supported on opposite sides of casing 24 for vertical sliding motion. The lock bars are utilized to lock drawers 32, 34 and 36 against movement. A lock rod 42 (FIGS. 2 and 3) is positioned within casing 24 along the top, front corner thereof in a conventional manner for controlling movement of lock bars 38, 40. Novel electronic lock 20 according to the invention is also positioned within the top of casing 24. A key reader 46 of lock 20, positioned above drawer 32, is accessible from externally of casing 24 (as best illustrated in FIG. 1) to control lock 20. Key reader 46 is utilized to input control signals from a key 48 (FIGS. 15 and 16), which signals are input to a controller 50 (shown in phantom in FIG. 1) via wires 52, 54, as described in greater detail hereinbelow. Depression of key reader 46 moves lock bars 38 and 40 to secure drawers 32, 34, and 36 against movement, as also described in greater detail hereinbelow.

As described briefly above, vertical file cabinet 22 in the illustrated embodiment includes elongated lock bars 38 and 40 which are of a conventional, metal construction. The lock bars have a U-shaped cross-sectional configuration. Lock bars 38 and 40 are conventional and may be of the type disclosed in U.S. Pat. No. 3,497,280 entitled GANG LOCK CABINET CONSTRUCTION which issued on Feb. 24, 1970 to Olree et al. The lock bars are positioned within casing 24 in a conventional manner such that they are oriented vertically for sliding movement. The lock bars carry respective latches (not shown), which may be of the type illustrated in U.S. Patent No. 3,497,280, to selectively engage each drawer 32, 34 and 36. The lock bars prevent movement of the drawers when they are in the locked position. The lock bars are preferably gravity loaded such that their own weight pulls them to the unlocked position. A spring (not shown) may be connected to each of the lock bars to reduce the force required to move the lock bars to the locked position.

Lock rod 42 extends across casing 24, as best illustrated in FIG. 2, and moves with lock bars 38 and 40. Lock rod 42 has a pivot axis $A_1$ (FIG. 3), which is the axis on which lock rod 42 rotates within casing 24. The lock rod includes three offset sections 56, 58, 60. Sections 56 and 60 are offset from pivot axis $A_1$, and are received for movement in lock bars 38 and 40, respectively. Section 58 is also offset from axis $A_1$. Section 58 projects from axis $A_1$ of the lock rod at an acute angle of at least 60° relative to sections 56 and 60. Accordingly, rotation of section 58 from the unlocked position (FIG. 21) to the locked position (FIG. 22) moves lock bars 38 (FIG. 3) and 40 upwardly around axis $A_1$. Lock bars 38 and 40 pull sections 56 and 60 downwardly around axis $A_1$, which rotates section 58 upwardly, when the lock bars move rod 42 to the unlocked position, as described in greater detail hereinbelow.

Lock 20 includes a plunger assembly 64, a catch assembly 65 (FIG. 4), and a lock box or lock bracket 72. Catch assembly 65 includes a catch 66, a solenoid 68, and a catch spring 70. Plunger assembly 64 comprises key reader 46, a key reader mount 74, a reader mount spring 76 and a wedge 78. Plunger assembly 64 is manually pressed to move the lock rod 42 to the locked position (FIG. 22) as described in greater detail hereinbelow. Catch 66 is controlled by catch spring 70 and solenoid 68 to move between locked (FIGS. 22 and 24) and unlocked positions (FIG. 23 and 25) as also described in greater detail hereinbelow.

Lock box 72 provides a housing or support for the remaining components of lock 20. Lock box 72 (FIGS. 4 and 5) is preferably integrally molded of a suitable polymer, such as the polymer available under the trade name DELRIN available from DuPont, which it is not electrically conductive. The lock box includes a U-shaped reader housing 80 having a front wall 82 and orthogonal side walls 84 and 86. Side walls 84 and 86 include rails 88 (FIG. 5) and 90 respectively. Front wall 82 includes an aperture 92 (FIG. 4), which is a round opening for receipt of key reader holder 74, as described in greater detail hereinbelow. Reader housing 80 projects outwardly from shoulders 94 and 96, respectively. Arms 98 and 100 project orthogonally from shoulders 94 and 96 respectively. Shoulders 94 and 96 include apertures 95 and 97 for receipt of a fastener (not shown) used to secure the lock box in casing 24. Shoulders 94 and 96 include posts 99 and 101 for positioning the lock box on casing 24. Arms 98 and 100 include channels 102 and 104, respectively, which receive lock rod 42. Channels 102 and 104 are preferably generally U-shaped to receive the lock rod, but may include a ridge (not shown) to receive the lock rod in a snap fit type connection. The connection holds the rod against vertical movement relative to lock box 72.

Figure 24:
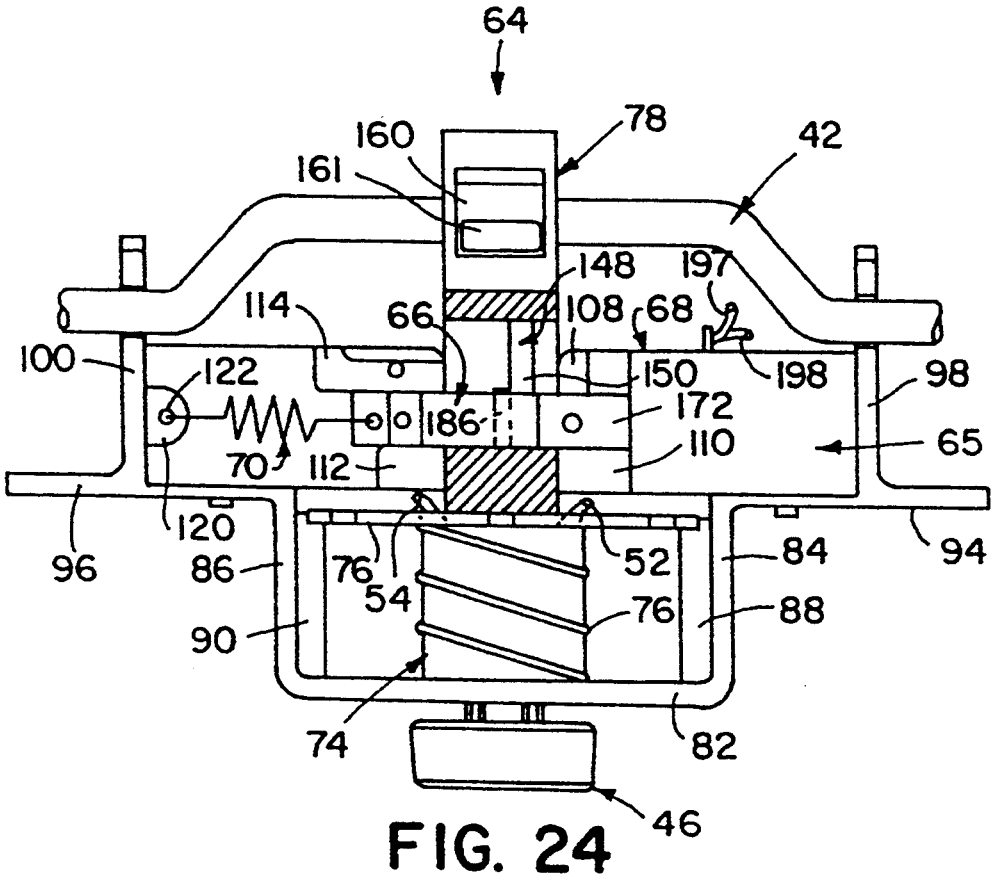
FIG. 24 is a top plan view of a lock assembly according to FIG. 2 in the locked position with the top half of the wedge block cut away and a fragmentary view of the lock rod.

A back wall 106 (FIG. 5) extends horizontally from shoulders 94 and 96 and between arms 98 and 100. In the illustrated embodiment, back wall 106 does not extend into the U-shaped reader mount housing 80, which reduces the number of parts required for the mold used to manufacture lock box 72. Blocks 108, 109, 110, 112 and 114 extend upwardly from back wall 106 and are utilized for positioning, and strength, as described in greater detail hereinbelow. A post 113 extends upwardly from block 114 for receipt of an optional lever described in greater detail hereinbelow with reference to FIGS. 17–20. Back wall 106 also includes short cylindrical posts 116 and 118 which are received in apertures (not shown) of solenoid 68 to securely position the solenoid against movement relative to the lock box. An anchor 120 extends inwardly from arm 100. The anchor includes an aperture 122 which receives one end of catch spring 70 (FIG. 24).

Key reader 46 (FIGS. 6 and 7) includes an outer ring contact 124 and an inner contact 126, which are electrically isolated by a cylindrical electrical insulator 128. Contact 124 is connected to a rearwardly projecting terminal 130 and contact 126 is connected to a rearwardly projecting terminal 132. Wire 52 (FIG. 1) is connected to terminal 130 (FIG. 7) by conventional means. Wire 54 (FIG. 1) is connected to terminal 132 (FIG. 7) by conventional means. Wires 52 and 54 are connected to electronic controller 50 (FIG. 1). A poet 134 (FIGS. 4 and 7) extends rearwardly from key reader 46 for insertion into key reader mount 74. Post 134 preferably includes four channels 136–139 (best illustrated in FIG. 7) positioned at 90° intervals around the perimeter thereof. The channels are preferably the same length as post 134 and extend parallel to the longitudinal axis of the post. Post 134 may be formed integrally with insulator 128. Contacts 124 and 126 may be assembled to the integral insulator and post.

Figure 23:
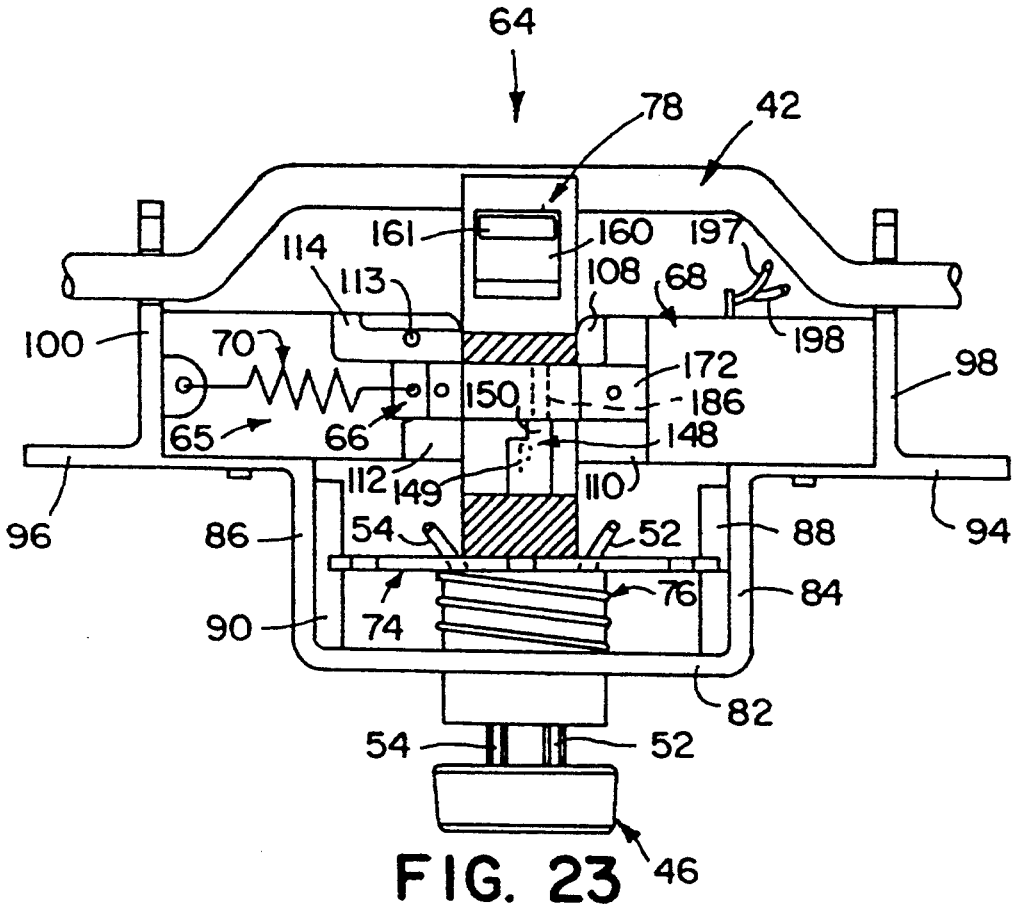
FIG. 23 is a top plan view of a lock assembly according to FIG. 2 in the unlocked position with the top half of the wedge block cut away and a fragmentary view of the lock rod.

Key reader mount 74 (FIGS. 4, 8 and 9) supports key reader 46 on lock box 72. Key reader mount includes a base 140 and a cylinder 141 projecting orthogonally from base 140. Cylinder 141 includes a central post receptacle 142 which has a common longitudinal axis with cylinder 141. Receptacle 142 receives key reader post 134 as described in greater detail hereinbelow. Tubes 129 and 131 extend rearwardly and outwardly from aperture 137 for passage of wires 52 and 54 The openings 129', 131' (FIG. 9) are preferably spaced laterally a distance at least equal to the width of wedge 78 to permit wires 52 and 54 to exit base 74 adjacent the wedge (FIGS. 23 and 24). Base 140 includes recesses 143 and 144 which receive rails 88 (FIG. 5) and 90, respectively, of lock box 72. Cylinder 141 moves within aperture 92 as recesses 143,144 slide on rails 88, 90.

Reader mount spring 76 (FIG. 4) is positioned over cylinder 141 of key reader mount 74, and between base 140 of key reader mount 74 and front wall 82 of lock box 72. Spring 76 imparts a force against base 140 and wall 82 which pushes the base away from the front wall.

Figures 4, 6, 7, 8, 9, 10, 11:
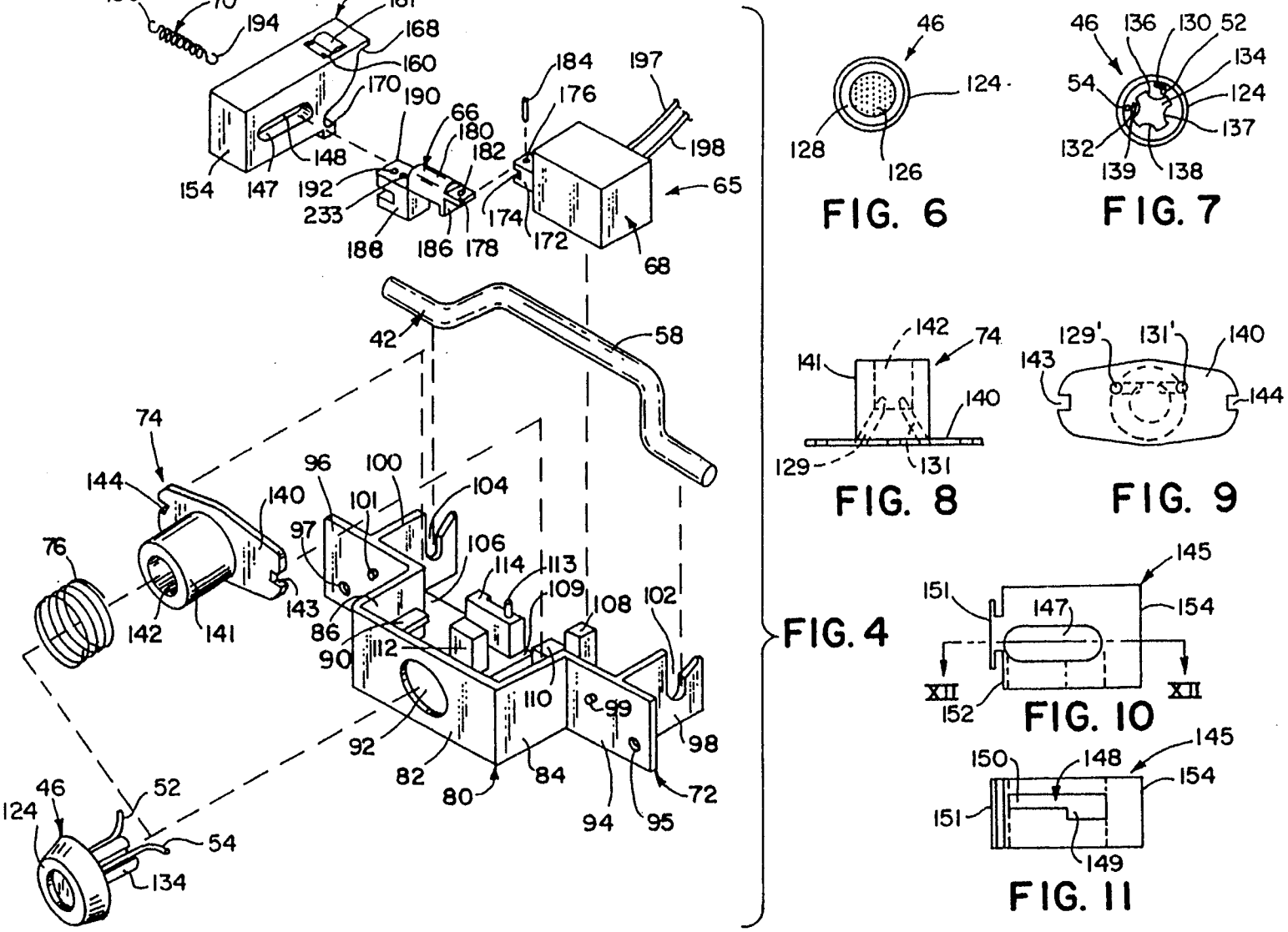
FIG. 4 is an exploded view of the electronic lock according to FIG. 2.
FIG. 6 is a front elevational view of a key reader for the lock assembly of FIG. 4.
FIG. 7 is a back elevational view of the key reader of FIG. 6.
FIG. 8 is a top plan view of a key reader mount for the lock assembly of FIG. 4.
FIG. 9 is a back elevational view of the key reader according to FIG. 8.
FIG. 10 is a side elevational view of a wedge block for the lock according to FIG. 4.
FIG. 11 is a bottom plan view of the wedge block according to FIG. 10.

Wedge 78 (FIG. 4) abuts base 140 and engages lock rod 42. Wedge 78 includes a wedge block 145 (FIGS. 10–12) and a rod engaging member 146 (FIG. 13). Wedge block 145 has a laterally extending channel 147 (FIG. 10) and a vertically extending, generally L-shaped, channel 148 (FIG. 11). Laterally extending channel 147 extends through block 145. The L-shaped channel 148 includes a notch 149 for receipt of catch 66 when the lock is in the locked positioned (FIG. 24) and a slot 150. Channels 147 and 148 intersect within wedge block 145. Wedge block 145 also includes a tail 151 (FIG. 10) which is generally T-shaped in cross-sectional shape and extends from an end wall 152. Tail 151 preferably extends the full width block 145 to give strength to the tail. An end wall 154, opposite end wall 152, is flat to abut with base 140 of key reader mount 72.

Rod engaging member 146 (FIG. 13) includes a channel 156 in a wall 158 for receipt of tail 157. Channel 156 is generally T-shaped in cross-section and extends the width of member 146. A recess 160 is provided in a top wall 162 of member 146. A roller bearing 161 (FIGS. 4 and 21–24), low-friction material is positioned in recess 160. In the alternative, an insert or plain bearing made of a low-friction material such as nylon, may be affixed in recess 160 by a suitable adhesive. The bearing or insert ride on or engage a portion of the cabinet. A curved rod engagement surface 164 is formed on a wall 166 opposite wall 158. Curved surface 164 has a radius of 0.55 to 0.7 inches, and preferably has a radius of 0.625 inches. Surface 164 is curved outwardly to provide a continuous resistance to movement when the plunger assembly 64 moves rod 30. The force required to push assembly 64 inwardly remains relatively constant throughout its range of motion. An upper stop projection 168 and a lower stop projection 170 terminate surface 164. The stop projections limit the movement of lock rod 42 and wedge 78 as described in greater detail hereinbelow.

Wedge block 142 and rod engaging member 146 are of any suitable construction, and are preferably integrally molded organic polymer such as that sold under the brand name Delrin. Rod engaging member 146 is assembled to wedge block 145 by inserting tail 151 into channel 156. Tail 150 may be secured in channel 156 by friction fit or use of a suitable adhesive. Alternatively, wedge block 145 and rod engaging member 146 may be molded as a single, integral unit.

Solenoid 68 (FIG. 4) and catch spring 70 control the position of a catch 66. Catch 66 is in turn positioned within channels 147 and 148 of wedge block 145 to control movement of plunger assembly 64 as described in greater detail hereinbelow. Solenoid 68 may be provided by any suitable solenoid, such as the commercially available solenoid TDS-06A, DC-6V, AZ20. The solenoid includes a solenoid pin 172 having a laterally extending slot 174. A vertical aperture 176 extends through pin 172 and intersects slot 174.

Catch 66 (FIGS. 4 and 14) includes a head 178, which is rectangular in cross-sectional shape, and projects from a cylindrical body 180. Head 178 mates with slot 174 in solenoid pin 172. Head 178 includes an aperture 182 which aligns with aperture 176 when head 178 is fully inserted in slot 174. A pin 184 inserted through apertures 176 and 182 secures head 178 in slot 174. A front leg 186 and a rear leg 188 extend downwardly from body 180. A tail 190 projects outwardly from body 180. Tail 190 includes an aperture 192 for receipt of catch spring 70. Catch 66 is of a suitable metal alloy construction.

Catch spring 70 (FIG. 4) includes hooks 194 and 196 on opposite ends thereof. Hook 194 of catch spring 70 is received in aperture 192 of tail 190. Hook 196 of catch spring 70 is received in aperture 122 (FIG. 5) of anchor 120

Key 48 (FIGS. 15 and 16) used with electronic lock 20 includes a memory button 214 having a unique code stored therein. The memory button includes a read-only-memory (ROM) (not shown) which stores a forty-eight bit code. Each key has a different code stored in its associated ROM. Button 214 also includes an outer ring contact 216 and an inner disk contact 217. Contacts 216 and 217 are connected to the internal ROM. The memory button 214 may be a commercially available memory device such as IC No. DS 1990 sold by Dallas Semiconductor. The memory button is mounted on a key body 218 using an adhesive. The key body may be of any suitable construction such as leather, a molded polymer, a metal alloy, or the like.

Controller 50 (FIG. 1) is connected to contacts 124 (FIG. 6) and 126 via wires 52 and 54. Controller 50 is also connected to solenoid 68 (FIG. 4) via wires 197 (FIGS. 1, 2 and 4) and 198. The controller reads the code stored in key 48 (FIGS. 15 and 16) when the key is connected to contacts 124 (FIG. 6) and 126. Controller 50 compares the code stored in key 48 with codes stored in controller 50 to determine whether the key is an enable key or a lock key. If key 48 is an enable key, the controller will perform a control function. For example, the controller may learn new lock key codes, remove existing lock key codes individually, or remove all existing lock key codes, as a function of how programming and lock keys are placed on key reader 46. If the key connected to reader 46 is a lock key, the controller sends a control signal to solenoid 68 via wires 197 and 198. The solenoid pulls catch 66 to the unlocked position (FIG. 23) which releases the cabinet drawers as described in greater detail hereinbelow. Controller 50 is connected to a conventional AC wall outlet (not shown) and receives AC power therefrom. An example of an electronic controller is disclosed in U.S. Pat. No. 4,392,133, entitled ELECTRONIC LOCK WITH CHANGEABLE OPENING CODE which issued on Jul. 5, 1983 to Lundgren, the disclosure of which is incorporated herein by reference thereto.

An electronic lock 220 (FIGS. 17–20) according to an alternate embodiment of the invention includes a lever 222 in addition to the components of lock 20 described above. Lever 222 includes a body 224 (FIG. 18) having a small diameter end 226 and a large diameter end 228. The body is of any suitable construction such as a molded organic polymer. An aperture 230 (FIG. 18) is provided on small diameter end 226. Aperture 230 receives a pin 231 which extends into aperture 233 (FIG. 14) of catch 66 to connect the lever to the catch. An elongated fulcrum aperture 232 is provided intermediate ends 226 and 228. Aperture 232 receives pin 113 (FIG. 17) of block 114, such that the lever rotates around the pin. Counterweights 234, 236 are mounted to opposite faces of lever body 224 on larger diameter end 228. The combined weights of counterweights 234, 236 is preferably equal to the combined weight of catch 66 and solenoid pin 172.

To assemble lock 20, reader mount spring 76 (FIG. 4) is positioned around cylinder 141 of reader mount 74. Cylinder 141 is inserted into aperture 92 of front wall 82 and base 140 is positioned between side walls 84 and 86 such that rail 88 (FIG. 5) is received in recess 143 (FIG. 4) and rail 90 is received in recess 144. Reader mount spring 76 is compressed between wall 82 and base 140 to bias the base away from wall 82 and into wedge 78. Wires 52 and 54, positioned in two of the four channels 136–139, are inserted through tunnels 129 (FIG. 8) and 131. Post 134 (FIG. 4) of key reader 46 is then pressed into post receptacle 142.

The catch 66 is then positioned within slot 147 of wedge block 145. When leg 186 is positioned over slot 148 (FIGS. 11 and 12), the catch is rotated 90°, which moves leg 186 in channel 148. The wedge 145 (FIG. 4) is then positioned on block 109 (FIG. 5) and between blocks 108, 110, 112 and 114. Solenoid 68 (FIG. 4) is positioned between arm 98 and blocks 108, 110 (see FIGS. 23 and 24). Solenoid 68 is secured to posts 116 (FIG. 5) and 118 of lock box 72. The solenoid may be secured to lock box 72 using a suitable adhesive. Head 178 (FIG. 4) of catch 66 is positioned within slot 174 of solenoid pin 172 such that apertures 176 and 182 are aligned. Pin 184 is inserted into apertures 176 and 182 to fixedly secure catch 66 to solenoid pin 172. Hook 194 of spring 70 is inserted into aperture 192. Hook 196 of spring 70 is inserted into aperture 122 (FIG. 5) of anchor 120. Base 140 of key reader mount 74 is positioned against wall 154 (as shown in FIG. 23) of wedge 78 when fully assembled. Base 140 may be fixedly secured to wall 154 of wedge 78 using a suitable adhesive. Glide bearing 161, is inserted into recess 160 to provide a low friction abutment against the interior of casing 24 as shown in FIGS. 21 and 22.

Figure 17:
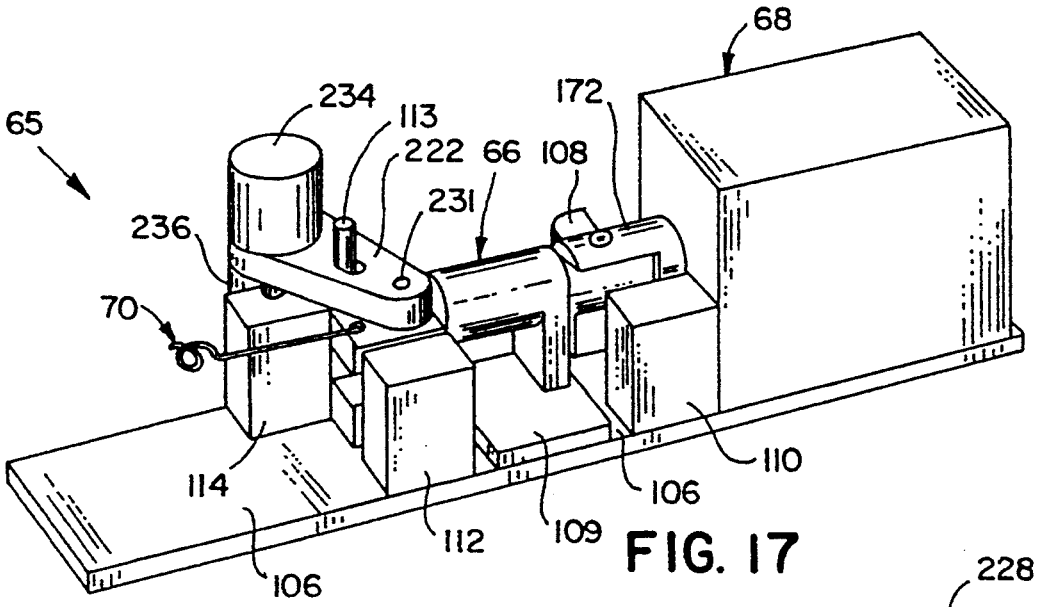
FIG. 17 is a fragmentary perspective view of an alternate embodiment of the catch assembly of the lock according to FIG. 2.
Figure 18:
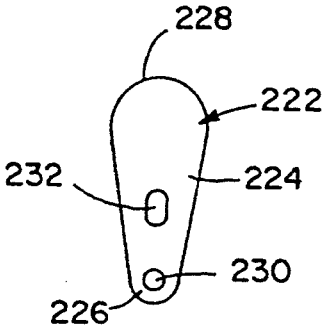
FIG. 18 is a top plan view of a lever in the catch assembly according to FIG. 17.
Figure 19:
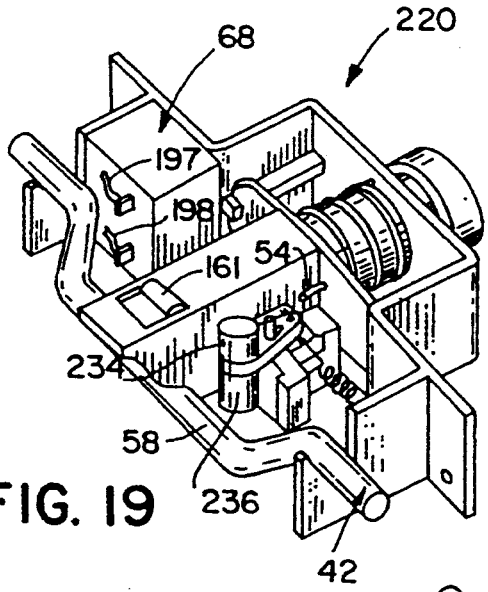
FIG. 19 is a perspective view of the alternate embodiment of FIG. 17 with the lock bar in the locked position.
Figure 20:
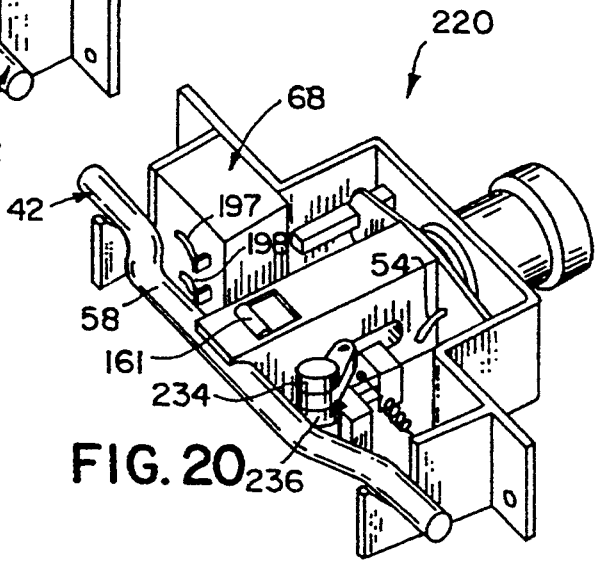
FIG. 20 is a perspective view of the alternate embodiment of FIG. 17 with the lock bar in the unlocked position.

In the alternate embodiment, aperture 232 (FIG. 18) of lever 222 is positioned to receive pin 113 (FIG. 17). Pin 231 is then inserted through aperture 230 (FIG. 18) and 233 (FIGS. 4 and 14) to connect the lever to catch 66.

Figure 21:
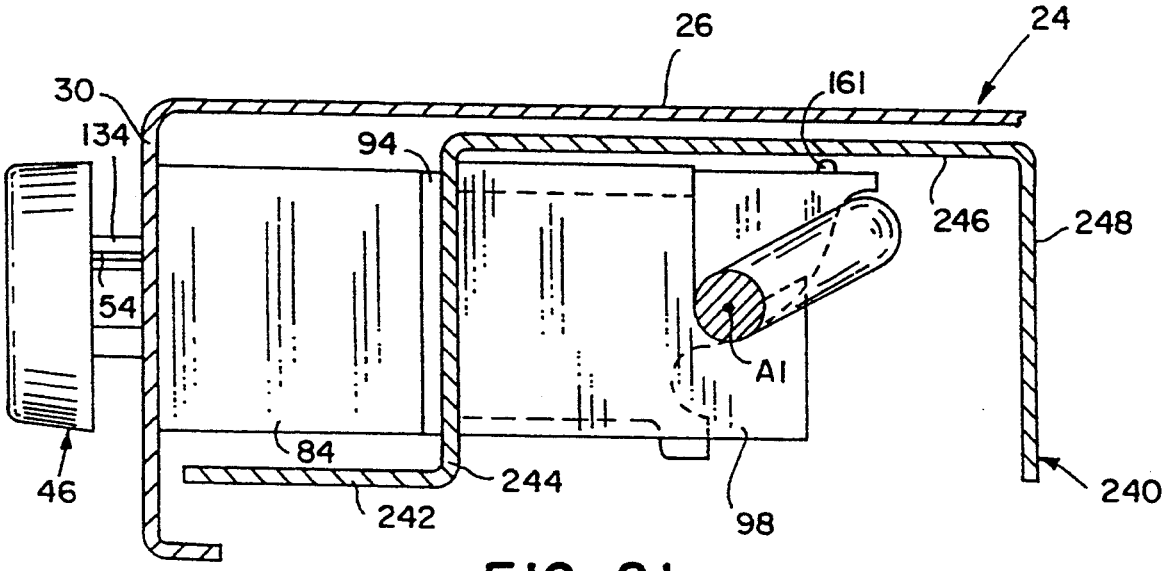
FIG. 21 is a fragmentary side cross-sectional view of the cabinet according to FIG. 1 taken along plane XXI—XXI in FIG. 2 with the lock in the unlocked position.
Figure 22:
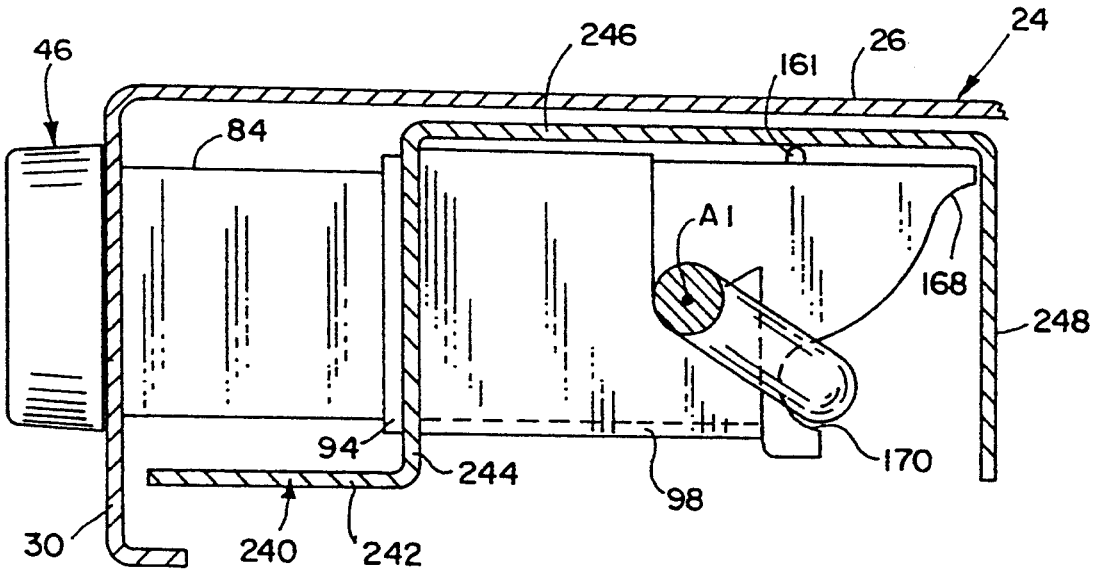
FIG. 22 is a fragmentary side cross-sectional view of the cabinet according to FIG. 1 taken along plane XXI—XXI in FIG. 2 with the lock in the unlocked position.

As illustrated in FIGS. 21 and 22, lock 20 is assembled into the upper front corner of casing 24 where walls 26 and 30 intersect a trough 240 which extends across casing 24. Trough 240 includes a horizontal wall 242, a vertical wall 244, a horizontal wall 246 and a vertical wall 248. Lock rod 42 is positioned between walls 244 and 248. In an existing cabinet the distance from wall 30 to wall 248 is 2.6 to 2.8 inches; the distance from wall 244 to wall 248 is 1.7 to 1.9 inches; and the distance from wall 26 to wall 242 is 1.0 to 1.2 inches.

Plunger assembly 64 extends through apertures (not shown) in front wall 30 and wall 244. In the illustrated embodiment, post 134 of key reader 46 is inserted through an aperture (not shown) in the front wall 30 such that the key reader is fully accessible from externally of cabinet 24. The lock box 72 is received in an aperture (not shown) in wall 244 and 242 such that shoulders 94 and 96 (FIG. 4) are positioned against wall 244 (FIGS. 21 and 22). Apertures 95 (FIG. 4) and 97 are aligned with apertures (not shown) on wall 244 to receive threaded fasteners, or the like. Pins 99 and 101 are received in apertures (not shown) in wall 244 to assist in positioning lock box 72. Lock rod 42 is received in channels 102 and 104 such that section 58 of the lock rod rests against surface 164 (FIG. 13) of rod engaging member 146.

OPERATION

The operation of lock assembly 20 will now be described with reference to FIGS. 21–24. The lock is changed from an unlocked condition (FIGS. 21 and 23) to a locked condition (FIGS. 22 and 24) by manually pushing key reader 46 inwardly. Key reader 46 moves mount 74 and wedge 78, which compresses spring 76. Wedge 78 causes clockwise rotation of lock rod 42 (as viewed in FIGS. 21 and 22). The force required to move rod 42 is substantially constant throughout the movement of plunger assembly 64 because surface 164 (FIG. 13) is curved. Leg 186 (Shown in phantom in FIGS. 23 and 24) of catch 66 slides in slot 150 as wedge 78 moves. When leg 186 is aligned with notch 149 (FIG. 24), catch spring 70 pulls leg 186 into the notch preventing movement of wedge 78. When catch leg 186 is engaged within notch 149, section 58 of lock rod 42 is positioned against stop 170 (FIG. 22). This provides a positive indication that the lock is in a locked position. In this position of lock bar 42, lock bars 38 and 40 are lifted and drawers 32, 34 and 36 are locked.

Lock 20 returns to the unlocked state from the locked state when contacts 216 and 217 of lock key 48 (FIGS. 15 and 16) are electrically connected to contacts 124 and 126 of key reader 46 (FIG. 6). Controller 50 reads the code stored in key 48 via conductors 52 and 54. The controller compares that code to authorized access codes stored in the controller. If the key code matches an authorized code, the controller supplies a control signal to solenoid 68 via conductors 197 and 198. The solenoid 68 is responsive thereto to retract pin 172. Catch 66 moves with pin 172. When leg 186 is aligned with slot 150, lock rod 42 pushes wedge 78 such that it slides to the unlocked position and compresses spring 76. When leg 186 is at the end of slot 150 opposite notch 149, section 58 of lock rod 42 is positioned against stop 168 (FIG. 21).

As described above, catch 66 is biased toward the locked position by spring 70 and an electrical signal must be input to solenoid 68 to move the catch to its unlocked positioned. The power down state for the lock is thus the locked position. Additionally, the lock assembly may be manually locked without electrical power being provided to the controller and solenoid. Accordingly, in a power outage, the lock assembly may be locked, but not unlocked, which increases the security of the device. It is envisioned that a conventional back-up power supply (e.g., a battery) could be provided to permit unlocking of the cabinet during a power outage.

The alternate embodiment of FIG. 5 operates in the same manner as lock 20 described above. Additionally, lever 222 pivots from its locked position (FIG. 19) to its unlocked position (FIG. 20) when catch 66 moves between its locked and unlocked positions. Counterweights 234 and 236 are equal in weight to catch assembly 66 and shaft 172 of solenoid 68. Thus, when the latch is in a locked position, a strong impact against a side of the cabinet will result in an equal force being exerted on both ends of lever 222, which are on opposite sides of fulcrum pin 113. This equal force prevents lateral sliding of catch assembly 65 responsive to a very large force impacting cabinet 24.

Accordingly, it can be seen that a lock is disclosed which is readily retrofittable in existing file cabinets. The Lock operates with existing furniture unit lock mechanisms. The lock uses a controller and electronic keys, and the controller may be reprogrammed by the user if a key is lost. The lock provides ease of operation and has solid operating feel when installed within a furniture unit. The lock provides reliable security, ease of installation, and low cost.

In the foregoing description, it will be readily perceived by those skilled in the art that modifications may be made to the invention without departing from the concepts disclosed herein. Although not illustrated, it is envisioned that the electronic lock could be provided as a twist lock. Such twist lock would include a cam coupled to key reader 46 for rotation therewith. The cam would include spring biasing to reduce the force necessary to pull the lock bars to a locked position. A solenoid including a pin would be coupled to the cam to lock the cam against movement when the lock bars are in the locked position. The pin could then be retracted to release of the cam, and allow movement of the lock bars to an unlocked position. It is also envisioned that a plurality of solenoids could be coupled to a single key reader and controller. The solenoids would all be released when a lock key is connected to the key reader. Finally, it is envisioned that the lock could include an infrared (IR) receiver for receipt of control signals from an IR transmitter. Such modifications are to be considered included in the following claims unless these claims by their language expressly state otherwise.

The embodiments of the invention in which an exclusive property or privilege is claimed are defined as follows.

1. An interface for an electronic controller in a furniture unit including a storage area, a closure member and a locking element for selectively locking said closure member to secure said storage area, comprising:

a housing having an interior surface;

a manually depressible plunger assembly carried on said housing, said plunger assembly including a plunger, means for engaging the locking element and means on said plunger for receiving an electrical control signal, said plunger assembly being manually movable to a locked position wherein the locking element is in a locked position and an unlocked position wherein the locking element is in an unlocked position; and a catch assembly including means for securing said plunger assembly in said locked position, said securing means operably coupled to said receiving means whereby said securing means releases said plunger assembly when an electrical control signal is input to said receiving means.

2. An interface as defined in claim 1, wherein said receiving means includes at least one electrical contact.

3. An interface as defined in claim 1, wherein said means for engaging the locking element includes an engaging member having a contact surface which engages the locking element.

4. An interface as defined in claim 3, wherein said contact surface is curved such that the force required to move said engaging member and said locking element is substantially constant throughout the length of movement of said engaging member.

5. An interface as defined in claim 3, wherein said engaging member further includes a recess and a spacer positioned in said recess, said spacer adapted to abut with the interior surface of the housing.

6. An interface as defined in claim 5, wherein said spacer is an insert member having a lower frictional coefficient than said engaging member.

7. An interface for an electronic controller in a furniture unit including a storage area, a closure member and a locking element for selectively locking said closure member to secure said storage area, comprising:

a housing having an interior surface;

a plunger assembly carried on said housing, said plunger assembly including means for engaging the locking element and means for receiving a control signal said plunger assembly having a locked position wherein the locking element is in a locked position and an unlocked position wherein the locking element is in an unlocked position; and a catch assembly including means for securing said plunger assembly in said locked position, said securing means operably coupled to said receiving means whereby said securing means releases said plunger assembly when a control signal is input to said receiving means, wherein said means for engaging the locking element includes an engaging member having a contact surface which engages the locking element, wherein said engaging member further includes a recess and a spacer positioned in said recess, said spacer adapted to abut with the interior of the housing, and wherein said spacer comprises a roller bearing which rolls in said recess when said engaging member moves.

8. An interface as defined in claim 3, wherein said catch assembly includes a catch positioned within said engaging member.

9. An interface as defined in claim 8, wherein said catch assembly further includes a solenoid, said solenoid and said receiving means coupled to a controller, said catch securing said engaging member against movement in a first position and permitting movement of said engaging member in a second position, said solenoid operably coupled to said catch to move said catch from said first position and said second position responsive to a control signal from said controller.

10. An interface as defined in claim 9, wherein said catch assembly further includes a spring coupled to said catch, said spring pulling said catch to said locked position when said wedge moves to its locked position.

11. An interface for an electronic controller in a furniture unit including a storage area, a closure member and a locking element for selectively locking said closure member to secure said storage area, comprising;

a housing having an interior surface;

a plunger assembly carried on said housing, said plunger assembly including means for engaging the locking element and means for receiving a control signal, said plunger assembly having a locked position wherein the locking element is in a locked position and an unlocked position wherein the locking element is in an unlocked position; and a catch assembly including means for securing said plunger assembly in said locked position, said securing means operably coupled to said receiving means whereby said securing means releases said plunger assembly when a control signal is input to said receiving means, wherein said means for engaging the locking element includes an engaging member having a contact surface which engages the locking element, wherein said catch assembly includes a catch positioned within said engaging member, said catch assembly further includes a solenoid, said solenoid and said receiving means coupled to a controller, said catch securing said engaging member against movement in a first position and permitting movement of said engaging member in a second position, said solenoid operably coupled to said catch to move said catch from said first position and said second position responsive to a control signal from said controller, wherein said catch assembly further includes a lever and a weight, one end of said lever coupled to said catch, the other end of said lever carrying said weight, whereby said weight provides a counterbalance against said catch to prevent accidental unlocking of said closure member.

12. An adaptor for an office furniture unit including a locking bar for selectively securing a closure member against movement, comprising:

a housing;

an electronic controller;

a plunger in said housing adapted to engage the locking bar in a locked position and release the locking bar to an unlocked position; and a key reader on said plunger coupled to said controller for receiving an electrical control signal and transmitting said control signal to said controller.

13. A furniture unit comprising:

a furniture housing;

a closure for a storage area in said furniture housing;

a lock bar positioned in said furniture housing for securing said closure member against movement in a locked position;

a lock box carried on said furniture housing;

an actuator carried in said lock box, said actuator including means for engaging said lock whereby said actuator is manually manipulated to move said lock bar to said locked position, said engaging means including:

a contact surface on said actuator which engages said lock bar, said contact surface being curved whereby the magnitude of force required to move said lock bar to a locked position is constant throughout the movement of the actuator.

14. The furniture unit as defined in claim 13, further including a signal receiver on said actuator for receiving a control signal, an electronic controller coupled to said signal receiver and means for releasing said actuator to an unlocked position responsive to a signal from said electronic controller.

15. The furniture unit as defined in claim 14, wherein said signal receiver includes at least one electrical contact mounted on said actuator.

16. A furniture unit comprising:

a furniture housing having a top;

a closure for a storage area in said furniture housing;

a lock bar positioned in said furniture housing for securing said closure member against movement in a locked position;

a lock box carried on said furniture housing;

an actuator carried in said lock box, said actuator including means for engaging said lock whereby said actuator is manipulated to move said lock bar to said locked position; and said actuator defines a recess and further includes a spacer positioned in said recess, said spacer abutting the top of said furniture housing when said actuator is manipulated.

17. A furniture unit comprising:

a furniture housing having a top;

a closure for a storage area in said furniture housing;.

a lock bar positioned in said furniture housing for securing said closure member against movement in a locked a lock box carried on said furniture housing;

an actuator carried in said lock box, said actuator including means for engaging said lock whereby said actuator is manipulated to move said lock bar to said locked position; and said actuator includes a recess and a spacer positioned in said recess, said spacer abutting the top of said furniture housing when said actuator is manipulated, and wherein said spacer includes a roller bearing positioned in said recess.

18. The furniture unit as defined in claim 16, wherein said spacer is an insert member having a lower frictional coefficient than said engaging member.

19. The furniture unit as defined in claim 16, further including a signal receiver for receiving a control signal, an electronic controller coupled to said signal receiver and means for releasing said actuator to an unlocked position responsive to a signal from said electronic controller.

20. The furniture unit as defined in claim 19, wherein said signal receiver includes at least one electrical contact mounted on said actuator.

21. A furniture unit comprising:

a furniture housing;

a closure for a storage area in said furniture housing;

a lock bar positioned in said furniture housing for securing said closure member against movement in a locked position;

a lock box carried on said furniture housing;

an actuator carried in said lock box, said actuator including means for engaging said lock whereby said actuator is manipulated to move said lock bar to said locked position; and a solenoid and a catch, said catch securing said actuator against movement when said catch is in a first position and said catch allowing movement of said actuator when said catch is in a second position, said solenoid operably coupled to said catch to move said catch between said first position and said second position.

22. The furniture unit as defined in claim 21, wherein said catch further includes a spring coupled to said catch, said spring pulling said catch to said locked position when said actuator moves to its locked position.

23. A furniture unit comprising:

a furniture housing;

a closure for a storage area in said furniture housing;

a lock bar positioned in said furniture housing for securing said closure member against movement in a locked position;

a lock box carried on said furniture housing;

an actuator carried in said lock box, said actuator including means for engaging said lock whereby said actuator is manipulated to move said lock bar to said locked position; and a solenoid and a catch, said catch securing said actuator against movement when said catch is in a first position and said catch allowing movement of said actuator when said catch is in a second position, said solenoid operably coupled to said catch to move said catch between said first position and said second position, and wherein said catch further includes a lever and a weight, one end of said lever coupled to said catch, the other end of said lever carrying said weight, whereby said weight provides a counterbalance against said catch to prevent accidental unlocking of said closure member.

24. The furniture unit as defined in claim 21, further including a signal receiver for receiving a control signal and an electronic controller coupled to said signal receiver and said solenoid whereby said catch is moved to said second position responsive to said electronic controller.

25. The furniture unit as defined in claim 24, wherein said signal receiver includes at least one electrical contact mounted on said actuator.

26. A furniture unit comprising:

a furniture housing;

a closure for a storage area in said furniture housing;

a lock bar positioned in said furniture housing for securing said closure member against movement in a locked position;

a lock box carried on said furniture housing;

an actuator carried in said lock box, said actuator including means for engaging said lock bar whereby said actuator is manipulated to move said lock bar to said locked position, said actuator further including a catch for securing said actuator in said locked position; and a lever and a weight, one end of said lever coupled to said catch, the other end of said lever carrying said weight, whereby said weight provides a counterbalance against said catch to prevent accidental unlocking of said closure member.

27. The furniture unit as defined in claim 26, further including a signal receiver for receiving a control signal, an electronic controller coupled to said signal receiver and means for releasing said actuator to an unlocked position responsive to a control signal from said electronic controller.

28. The furniture unit as defined in claim 27, wherein said signal receiver includes at least one electrical contact mounted on said actuator.

* * * * *

UNITED STATES PATENT AND TRADEMARK OFFICE

CERTIFICATE OF CORRECTION

PATENT NO. : 5,385,039

DATED : January 31, 1995

INVENTOR(S) : Thomas G. Feldpausch et al.

It is certified that error appears in the above-indentified patent and that said Letters Patent is hereby corrected as shown below:

Column 4, line 39;
"(Fig. 23 and 25)" should be –(Figs. 23 and 25)–.

Column 5, line 25;
"poet" should be –post–.

Column 5, line 43;
After "54" insert –.–.

Column 9, line 23;
"positioned." should be –position.–.

Column 9, line 48;
"Lock" should be –lock–.

Column 12, claim 17, line 51;
After "locked" insert –position;–.

Signed and Sealed this

Third Day of October, 1995

*Attest:*

Bruce Lehman

BRUCE LEHMAN

*Attesting Officer*

*Commissioner of Patents and Trademarks*